US008210739B2

(12) United States Patent
Greubel et al.

(10) Patent No.: US 8,210,739 B2
(45) Date of Patent: Jul. 3, 2012

(54) TOURBILLON MOVEMENT FOR TIMEPIECE

(75) Inventors: Robert Greubel, Lignieres (CH); Stephen Forsey, Les Brenets (CH)

(73) Assignee: CompliTime SA, La Chaux-de-Fonds (CH)

( * ) Notice: Subject to any disclaimer, the term of this patent is extended or adjusted under 35 U.S.C. 154(b) by 290 days.

(21) Appl. No.: 12/594,669

(22) PCT Filed: Apr. 3, 2008

(86) PCT No.: PCT/EP2008/053980

§ 371 (c)(1),
(2), (4) Date: Oct. 5, 2009

(87) PCT Pub. No.: WO2008/125503

PCT Pub. Date: Oct. 23, 2008

(65) Prior Publication Data

US 2010/0046329 A1 Feb. 25, 2010

(30) Foreign Application Priority Data

Apr. 5, 2007 (CH) ..... 571/07

(51) Int. Cl.
*G04B 15/00* (2006.01)

(52) U.S. Cl. ..... 368/127

(58) Field of Classification Search ..... 368/124, 368/125, 127, 132, 168, 169
See application file for complete search history.

(56) References Cited

U.S. PATENT DOCUMENTS

| | | | | |
|---|---|---|---|---|
| 6,846,104 | B2 * | 1/2005 | Geyer | 368/127 |
| 7,160,026 | B2 * | 1/2007 | Golay | 368/127 |
| 7,445,375 | B2 * | 11/2008 | Kasapi | 368/127 |
| 7,677,793 | B2 * | 3/2010 | Lete et al. | 368/127 |
| 7,815,364 | B2 * | 10/2010 | Kasapi et al. | 368/127 |
| 7,857,501 | B2 * | 12/2010 | Salathe | 368/127 |
| 2009/0268565 | A1 * | 10/2009 | Salathe | 368/131 |
| 2010/0046329 | A1 * | 2/2010 | Greubel et al. | 368/132 |

FOREIGN PATENT DOCUMENTS

| | | |
|---|---|---|
| EP | 1 564 608 | 8/2005 |
| WO | 03/017009 | 2/2003 |
| WO | 2005/043257 | 5/2005 |
| WO | 2007/033513 | 3/2007 |

OTHER PUBLICATIONS

R. Meis, "Le Tourbillon", ISBN No. 2-58917-097-8, pp. 70-75.
International Search Report dated Sep. 15, 2008, from corresponding PCT application.

* cited by examiner

*Primary Examiner* — Vit Miska
(74) *Attorney, Agent, or Firm* — Young & Thompson

(57) ABSTRACT

A movement for a timepiece, that includes: a housing (10, 12); an energy source; a gear driven by the energy source (14); a frame (26) for a tourbillon (18) rotatingly mounted on the housing (10, 12) about a first axis (AA) and driven by the gear (14); a balance (32) mounted so as to oscillate in bearings on the frame (26); and an escapement (16, 34) including a fixed wheel (16) and a control member (34) interacting with the balance (32), the fixed wheel (16) sustaining the balance (32). In this movement, the bearings are arranged so that the balance (32) oscillates about a second axis (BB) inclined relative to the first axis (AA).

11 Claims, 1 Drawing Sheet

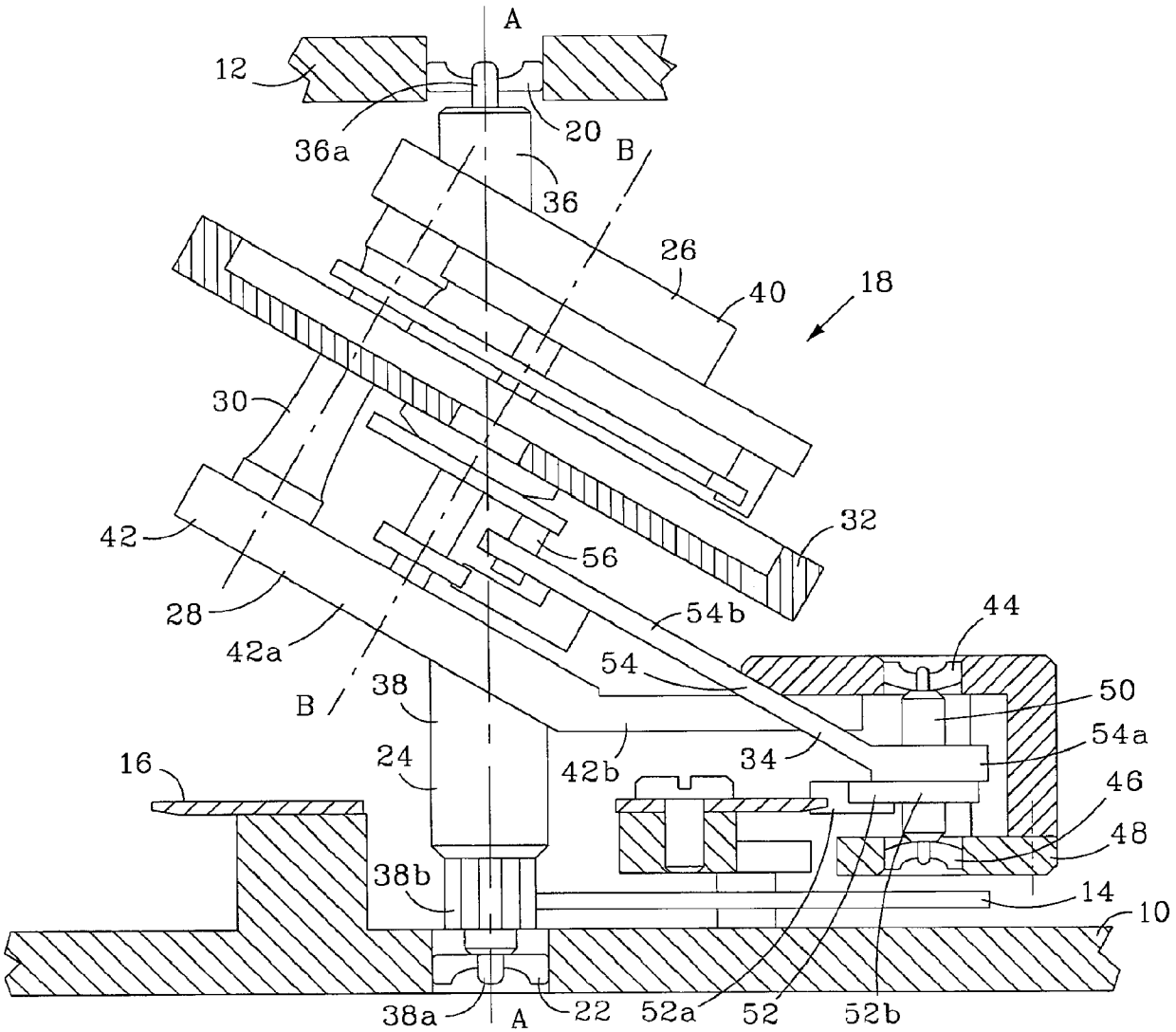
18
12
20
36a
36
A
B
26
40
32
30
42
28
42a
B
38
24
38b
38a
A
22
16
42b
54
54b
56
34
52a
52
52b
44
50
54a
46
48
14
10

TOURBILLON MOVEMENT FOR TIMEPIECE

TECHNICAL FIELD

The present invention relates to tourbillon movements for timepieces. Such movements are well known by those skilled in the art. The tourbillon is a device making it possible to improve the precision of the timepiece. It comprises a cage rotatingly mounted on the frame of the timepiece and a balance mounted so as to oscillate in the cage. The oscillating movement of the balance is generally maintained by an escapement also mounted on the cage. The cage is driven in rotation by a train whereof the last wheel meshes with a pinion integral with the cage. The escape-wheel, mounted on the cage, meshes with a fixed wheel.

BACKGROUND OF THE INVENTION

Certain clockmakers have developed so-called rapid tourbillons, in which only the anchor is located on the cage, the escapement wheel being mounted fixed on the frame of the movement. Such solutions are described in the work entitled "Le Tourbillon" by R. Meis, ISBN No. 2-58917-097-8.

Such devices have been the object of only a few unique pieces. Although the total inertia of the tourbillon is substantially reduced, it is nevertheless significant given that, for construction reasons, it is difficult to image having more than approximately twelve teeth on the fixed escape-wheel. This amounts to saying that, if the balance oscillates at a frequency of 3 Hz, the cage must perform one revolution in four seconds.

Moreover, also know are tourbillon-type devices described, for example, in documents WO 2007/033513, WO 2005/043257, WO 03/017009 and EP 1 564 608. But in these devices, the escape-wheel connected to the anchor is mounted pivotingly on the cage of the tourbillon. These documents therefore cannot be taken into account to resolve the problems which concern devices comprising a fixed escape-wheel.

The present invention aims in particular to realize a tourbillon timepiece comprising a fixed escape-wheel, in which the rotational speed of the cage is reduced.

BRIEF DESCRIPTION OF THE INVENTION

The timepiece movement according to the invention comprises:

a frame, an energy source, a train driven by the energy source, a tourbillon cage mounted rotatingly on the frame around a first axis and driven by said train, a balance mounted oscillating on the cage in bearings, and an escapement comprising a fixed wheel and a control organ cooperating with the balance and the fixed wheel in order to sustain the balance.

It is characterized in that the bearings of the balance are arranged such that this balance oscillates around a second axis which is inclined in relation to the first axis. In this way, it is possible to have a relatively long leverage of the control organ of the escapement without, however, increasing the total inertia of the cage. This makes it possible to increase the number of teeth of the fixed wheel and thus to reduce the rotational speed of the cage.

ADVANTAGEOUSLY

The incline angle is between 15° and 50°;

The escapement is of the lever type;

The escape-wheel is of the exterior toothing type.

BRIEF DESCRIPTION OF THE DRAWINGS

Other characteristics of the present invention will appear more clearly upon reading the description which follows, done in reference to the appended drawing, in which the sole FIGURE shows, in diagrammatic cross-section, a part of the timepiece movement according to the invention.

DETAILED DESCRIPTION OF THE INVENTION

The timepiece part illustrated in the drawing comprises in particular:

a frame comprising a plate 10 and a tourbillon bridge 12, a going train whereof only one wheel 14 is visible, a fixed wheel 16 mounted rigidly on the plate 10, and a tourbillon 18, mounted rotatingly between two bearings 20 and 22, one integral with the plate 10, the other integral with the bridge 12, around an axis AA perpendicular to the plane of the plate 10.

The tourbillon 12 comprises a cage 24, made up of two portions 26 and 28 connected to each other by pillars 30, only one of these being visible in the drawing, a balance 32 and an anchor 34, both mounted pivoting on the cage 24.

The two portions 26 and 28 each comprise an arbor portion referenced 36 and 38, respectively, and a board referenced 40 and 42, respectively. The arbors 36 and 38 are each provided with a pivot-shank 36*a* and 38*a*. Moreover, the arbor 38 forms a pinion 38*b* engaged with the wheel 14.

The arbor 36 and the board 40 are integral with each other. The latter part is inclined in relation to the arbor by an angle of approximately 60°. It is pierced with a hole in which a balance bearing, not shown in the drawing, is countersunk traditionally. The latter part receives, traditionally, one of the pivots of the balance 32.

The arbor 38 and the board 42 are also integral with each other. The latter part comprises a first portion 42*a* inclined in relation to the arbor 38 and parallel to the board 40, and a second portion 42*b* arranged perpendicular to the axis of the arbor 38. A hole is formed in the first portion 42*a*, aligned in relation to the hole of the board 40, in order to form the second bearing of the balance 32, together forming a pivot axis BB of the balance 32. Another hole is formed in the portion 42*b*, in which a jewel 44 forming bearing for the anchor 34 is countersunk. The latter part furthermore pivots in a second jewel 46 supported by a bridge 48, which is fixed on the portion 42*b*, using a screw illustrated by a broken line.

The anchor 34 comprises a shaft 50 mounted pivotably in the bearings 44 and 46, with an axis parallel to the axis AA. The shaft 50 supports, rigidly fixed, a piece 52 formed by pallets 52*a* and their support 52*b*, as well as a fork 54. The piece 52 is substantially oriented in a plane perpendicular to the axis AA. Its pallets 52*a* cooperate with the fixed wheel 16.

The fork 54 comprises a portion 54*a* engaged on the shaft 50 and a tail 54*b* inclined in a direction substantially parallel to the board 40 and to the portion 42*b* of the board 42. It extends to the vicinity of the balance 32, allowing the transmission of energy to the latter part via a tray 56 integral with the arbor of the balance 32.

Thanks to the fact that the fork is inclined, its length can be increased, such that, for a same impulse angle on the balance, the anchor travels over a smaller angle. It is thus possible to increase the number of pitches per revolution and, in this way, reduce the rotational speed of the tourbillon. With such a configuration, it appears possible to realize a wheel with thirty teeth, which, with a balance oscillating at a frequency of 3 HZ, causes the tourbillon to perform one revolution in ten seconds.

In the embodiment which was just described, the anchor pivots on an axis parallel to the axis of the cage. It is also possible to use an anchor pivoting on an axis parallel to the axis of the balance. In this case, the escape-wheel, which is fixed, will advantageously have a toothing inscribed in a truncated cone.

In both of the embodiments mentioned above, it would also be possible to use a fixed wheel with an inner toothing, the pallets then being turned outwardly.

Other types of escapements can also be used. Thus, inclining the balance in relation to the axis of rotation of the cage also allows other perspectives. It is thus entirely possible to produce a structure in which the balance tray is substantially off center in relation to the axis of rotation of the cage, even when the center of gravity of the balance is substantially on this axis.

With a configuration of this type, it is possible to use an escapement in which at least every other impulse is given directly to the balance without going through the anchor, which is then replaced by a control member attached to the balance and which frees the tourbillon when the balance can receive an impulse.

It is even possible to use a dead-beat escapement, such as a cylinder escapement. In this case, the control organ will be formed by the cylinder, which is connected to the balance.

The tourbillon described turns on two bearings arranged at its axial ends. It is quite clear that the same principle can also be applied to a tourbillon of the flywheel type.

In another variation which was not illustrated, the movement could comprise two tourbillon cages, the first being mounted pivoting on the second. The fixed wheel 16 would then be fixed on the second cage. In this case, the axis of the first cage, in which the balance oscillates, would be inclined in relation to the axis of the balance.

Thus, owing to the fact that the balance is inclined in reference to the axis of the cage in which it is mounted so as to oscillate, it is possible to realize a tourbillon in which the escape-wheel is fixed and the cage of which turns at a reasonable speed, all while improving the precision of the watch.

The invention claimed is:

1. A timepiece movement comprising:

a frame, an energy source, a train driven by the energy source, a tourbillon cage mounted rotatingly on the frame around a first axis (AA) and driven by said train, a balance mounted oscillating on the cage in bearings, said bearings being arranged such that said balance oscillates around a second axis (BB) which is inclined in relation to the first axis (AA), and an escapement, said escapement comprising a fixed escape-wheel mounted fixed on the frame and a control organ cooperating with the balance and the fixed escape-wheel in order to sustain the balance.

2. The movement according to claim 1, wherein the incline angle between the two axes is between 15° and 50°.

3. The movement according to claim 1, wherein the escapement is of the lever type.

4. The movement according to claim 1, wherein the fixed escape-wheel is of the exterior toothing type.

5. The movement according to claim 3, wherein the fixed escape-wheel is of the exterior toothing type.

6. The movement according to claim 1, wherein the cage of said tourbillon turns on two bearings arranged at ends of the cage.

7. A timepiece movement comprising:

a frame;

an energy source;

a train driven by the energy source;

a first tourbillon cage mounted rotatingly on the frame and driven by said train;

a second tourbillon cage mounted pivoting on said first tourbillon cage around a first axis;

a balance mounted oscillating on the second tourbillon cage in bearings, said bearings being arranged such that said balance oscillates around a second axis which is inclined in relation to the first axis; and an escapement, said escapement comprising a fixed escape-wheel mounted fixed on the first tourbillon cage and a control organ cooperating with the balance and the fixed escape-wheel in order to sustain the balance.

8. The movement according to claim 7, wherein the incline angle between the two axes is between 15° and 50°.

9. The movement according to claim 7, wherein the escapement is of the lever type.

10. The movement according to claim 7, wherein the fixed escape-wheel is of the exterior toothing type.

11. The movement according to claim 7, wherein said first tourbillon cage turns on two bearings arranged at ends of the first tourbillion cage.

* * * * *